US011731853B2

(12) United States Patent
Kirsch

(10) Patent No.: US 11,731,853 B2
(45) Date of Patent: Aug. 22, 2023

(54) ROLL HOLDER FOR A LABEL ROLL

(71) Applicant: Bizerba SE & Co. KG, Balingen (DE)

(72) Inventor: Sascha Kirsch, Burladingen (DE)

(73) Assignee: Bizerba SE & Co. KG, Balingen (DE)

( * ) Notice: Subject to any disclaimer, the term of this patent is extended or adjusted under 35 U.S.C. 154(b) by 233 days.

(21) Appl. No.: 16/555,802

(22) Filed: Aug. 29, 2019

(65) Prior Publication Data

US 2020/0071014 A1 Mar. 5, 2020

(30) Foreign Application Priority Data

Aug. 29, 2018 (EP) ..... 18191401

(51) Int. Cl.

| | |
|---|---|
| ***B65H 75/24*** | (2006.01) |
| ***B65C 9/18*** | (2006.01) |
| ***B65C 9/46*** | (2006.01) |
| ***B65B 11/00*** | (2006.01) |

(52) U.S. Cl.

CPC ..... *B65H 75/241* (2013.01); *B65B 11/00* (2013.01); *B65C 9/18* (2013.01); *B65C 9/46* (2013.01)

(58) Field of Classification Search

CPC ..... B65C 9/18; B65C 9/46; B65C 9/1892; B65B 11/00; B65H 75/24; B65H 75/242; B65H 75/248; B65H 75/2484; B65H 2701/192; B65H 2701/194; B65H 2801/75; B65H 16/04; B65H 75/241

See application file for complete search history.

(56) References Cited

U.S. PATENT DOCUMENTS 2,756,891 A 7/1956 Hill
4,867,391 A * 9/1989 Resch ..... B65H 75/241 242/118.5

(Continued)

FOREIGN PATENT DOCUMENTS

DE 42 15 568 A1 11/1993
EP 3 187 425 A1 7/2017

(Continued)

OTHER PUBLICATIONS

Translation of JP H09 232063 (Sumitomo Wiring Systems) Sep. 5, 1997 (Year: 1997).*

(Continued)

*Primary Examiner* — George R Koch
(74) *Attorney, Agent, or Firm* — Kilpatrick Townsend & Stockton LLP

(57) ABSTRACT

The invention relates to a roll holder for a label roll, in particular for a label printer for a packaging machine for wrapping products with a packaging film, having an horizontally arranged, fixed-position holding mandrel whose one end is fastened to a carrier and whose other end projects in an unsupported manner from the carrier, and having a first roll mount and a second roll mount separate from the first roll mount, wherein the first roll mount is configured to engage into a first end of the label roll, and wherein the second roll mount is configured to engage into a second end of the label roll, such that the label roll is receivable between the two roll mounts, with the second roll mount being pushable onto the holding mandrel from the unsupported end of the holding mandrel.

19 Claims, 7 Drawing Sheets

(56) References Cited

U.S. PATENT DOCUMENTS

Figure 1:
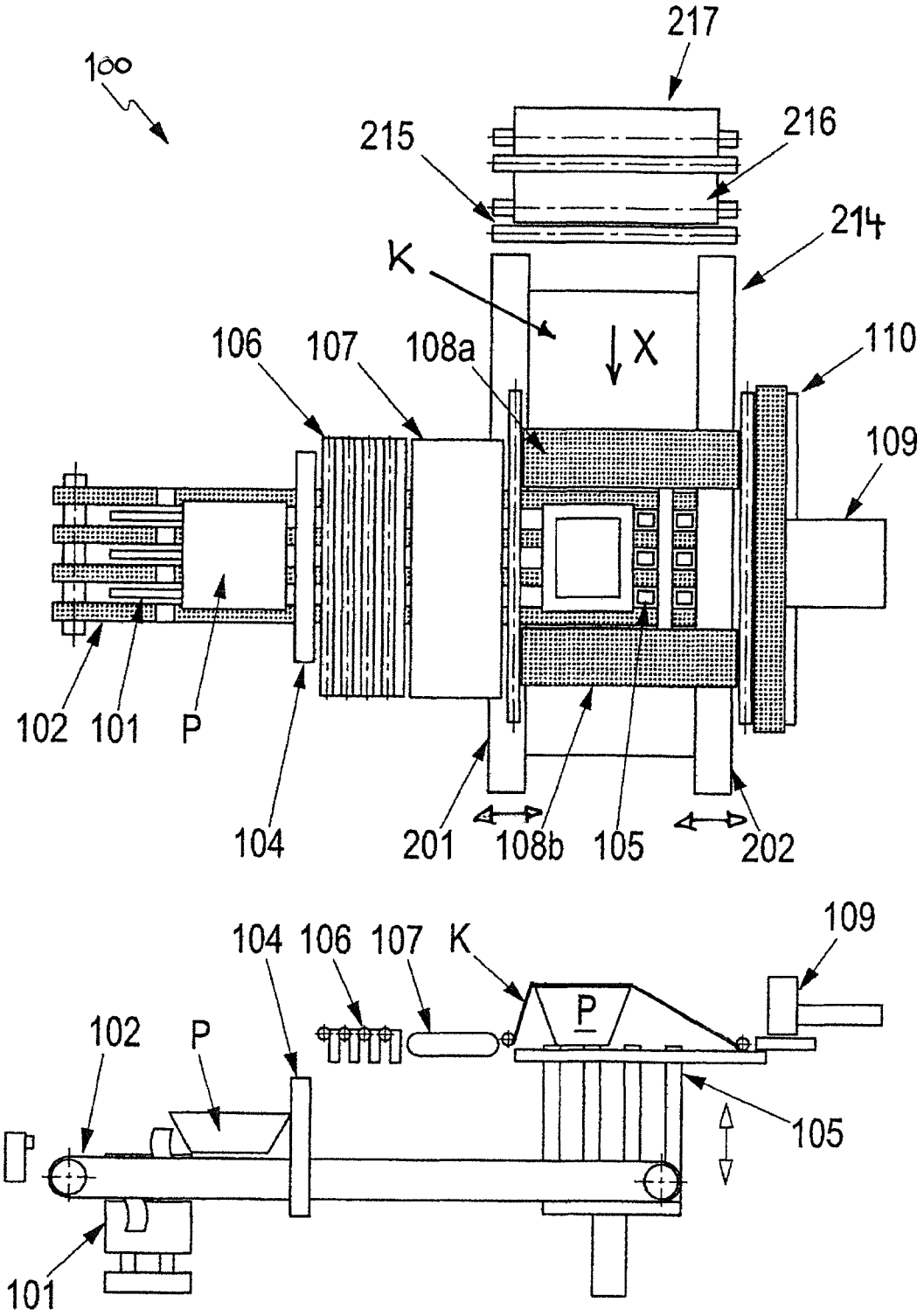

| | | | | |
|---|---|---|---|---|
| 4,936,522 | A * | 6/1990 | LeDuc | B65H 54/58 242/575.1 |
| 7,261,254 | B2 | 8/2007 | Mindler | |
| 2016/0347574 | A1 * | 12/2016 | Yu Chen | B65B 67/085 |
| 2017/0190453 | A1 | 7/2017 | Heller | |

FOREIGN PATENT DOCUMENTS

| | | | |
|---|---|---|---|
| JP | H09-232063 | A | 9/1997 |
| WO | 2018/055085 | A1 | 3/2018 |

OTHER PUBLICATIONS

Translation of DE 4215568 A1 (Esselte Meto Int Gmbh [DE]), Nov. 18, 1993 (Year: 1993).*

European Search Report dated Mar. 22, 2019 in corresponding European Patent Application No. 18191401.1 (three pages).

* cited by examiner

ROLL HOLDER FOR A LABEL ROLL

This application claims priority to European Patent Application No. 18191401.1, filed Aug. 29, 2018, the disclosure of which is incorporated by reference herein.

The present invention relates to a roll holder for a label roll, in particular having roll guides, in particular for a label printer for a packaging machine for wrapping products with a packaging film.

A packaging machine is known from EP 3 187 425 A1 in which products, in particular food products, are weighed and are wrapped with a packaging film. Such a packaging machine furthermore typically has a labeling apparatus and at least one printer to provide the respective product or the respective package with a respective label on which the price for the respective product and its weight are printed.

The labels here are arranged on a label roll that is held by a roll holder of the label printer. Roll holders are known in this respect that have a holding mandrel that receives the label roll. Roll holders having a rotatable holding mandrel such as are known from U.S. Pat. No. 7,261,254 B2 have the disadvantage that they cannot be used for label rolls of different widths. The label rolls frequently have too much play on fixed-position holding mandrels onto which the label rolls are directly pushed, in particular when label rolls having hollow cylindrical roll cores are used that have varying inner diameters—for example due to the production or due to the use of label rolls of different manufacturers or due to the use of different label roll types—so that the label rolls tend to lag on a jerky rolling off.

It is the underlying object of the invention to provide a roll holder of the initially named kind that is adaptable to label rollers of different widths and that prevents a lagging of the label rolls even on a jerky rolling off.

The object is satisfied by a roll holder for a label roll having the features of claim 1 and in particular by a roll holder having an horizontally arranged, fixed-position holding mandrel whose one end is fastened to a carrier and whose other end projects in an unsupported manner from the carrier, and having a first roll mount and a second roll mount separate from the first roll mount, wherein the first roll mount is configured to engage into a first end of the label roll, in particular of a hollow cylindrical roll core of the label roll, and wherein the second roll mount is configured to engage into a second end of the label roll, in particular of a hollow cylindrical roll core of the label roll, such that the label roll is receivable between the two roll mounts, with the second roll mount being able to be pushed onto the holding mandrel from the unsupported end of the holding mandrel.

Since the roll holder in accordance with the invention comprises two mutually separate roll mounts that engage at the two ends of the label roll, the roll holder automatically adapts to the respective width of the label roll, i.e. the label holder can be used for label rolls of different widths, at least for so long as the width of the label rolls is not greater than the length of the holding mandrel used. It is furthermore achieved by the two roll mounts that the label roll does not have to rotate directly on a fixed-position holding mandrel. The two roll mounts are rather interposed, with differences in the inner diameter of the roll cores of the label rolls being able to be compensated at the interface between the respective label roll and the roll mounts.

In accordance with a preferred embodiment, the second roll mount comprises an inner element, in particular of sleeve shape, that can be pushed onto the holding mandrel, an outer element that engages into the second end of the label roll and that is axially fixedly and rotatably supported on the inner element, and a clamping mechanism, with the clamping mechanism being configured to fix the inner element in a rotationally fixed and axially fixed manner on the holding mandrel. The second roll mount is accordingly formed in a multipart manner, so-to-say with an internal bearing. The outer element forms the interface to the label roll and is rotatably supported on the inner element, with the inner element and thus the total second roll mount being able to be fixed on the holding mandrel by the clamping mechanism. It is thus possible in a simple manner to mount the label roll in a rotatable, but simultaneously axially fixed, manner on the fixed-position holding mandrel.

The clamping mechanism preferably comprises a clamping insert, in particular of tubular or sleeve shape, in particular a clamping sleeve, that is coaxial to the inner element and is arranged between the holding mandrel and the inner element, and that is adjustable by axial adjustment between a release position in which the inner element is displaceable on the holding mandrel and a blocked position in which the inner element is rotationally fixedly and axially fixedly fixed on the holding mandrel, in particular while forming a conical clamping connection. The inner element can hereby be reliably fixed on the fixed-position holding mandrel in a particularly simple manner. The clamping insert can in particular have a clamping section having a conical outer diameter and the inner element can have a contact section having a counter-shaped conical inner diameter to form a conical clamping connection in the blocked position of the clamping insert.

The clamping mechanism preferably comprises an actuation element, in particular a ring nut, coupled to the clamping insert to adjust the clamping insert between the release position and the blocked position. It therefore does not have to be directly placed on the clamping insert, in particular by hand or using a tool, to adjust the clamping insert between the two positions, but the existing actuation element that can in particular be operated comfortably and/or intuitively can rather be used for this purpose.

The actuation element is in particular axially fixedly coupled or connected to the inner element and is formed as a ring nut having an internal thread that is screwed onto an external thread of a coupling section of the clamping insert for coupling to the clamping insert. The actuation element can in particular have an undercut at its end section facing the inner element and at least one securing element, in particular a semicircular washer, that is screwed to the inner element, in particular a flange of the inner element facing the actuation element, is inserted into said undercut. Two such securing elements are preferably provided.

The rotatable support of the outer element is preferably realized on the inner element by at least one roller element bearing provided between the outer element and the inner element. A roller element bearing has a higher running smoothness and a higher service life in comparison with a plain bearing. Furthermore, plain bearings have a higher friction torque, in particular on the or each start-up. A plain bearing is, however, generally also conceivable in the present invention.

The first roll mount and the second roll mount, in particular the aforesaid outer element of the second roll mount, preferably each comprise a flange, in particular a peripheral flange, to each of which a respective boundary disk for the label roll is fastened, in particular screwed. An unwanted lateral sliding down of the windings, in particular of the outer windings, of the label band of the label roll, in particular from the aforesaid roll core, can hereby be effectively prevented.

Provision is in particular made that the first roll mount comprises a first mound section to engage into the first end of the label roll and the second roll mount, in particular the aforesaid outer element of the second roll mount, comprises a second mount section to engage into the second end of the label roll.

It is preferred here if the two mount sections are each formed as conically tapering, in particular such that the first mount section tapers in the direction of the unsupported end of the holding mandrel and the second mount section tapers in the direction of the end of the holding mandrel fastened to the carrier. A sufficiently strong clamping effect between the label roll and the respective mount section can hereby be achieved by a pressing of the respective mount section into the respective end of the label roll, in particular of the aforesaid hollow cylindrical roll core of the label roll, to ensure a common rotation of the label roll with the mount sections. Furthermore, mutually differing inner diameters of the label rolls can hereby be compensated in a simple manner.

Provision can furthermore be made that the two mount sections each have a sharp-edged rib, said ribs tapering, in particular to a point, in the axial direction and pressing into the label roll, in particular into the aforesaid roll core of the label roll, said roll core frequently being made from cardboard, on engagement into the respective end of the label roll. A clamping effect between the label roll and the two mount sections can hereby be provided and/or increased.

In accordance with a further embodiment of the invention, the two mount sections each comprise a plurality of prolongations arranged distributed in the peripheral direction, with the prolongations of the two mount sections being able to engage in a finger-like manner into one another on at least one rotational position of the two mount sections toward one another. The two mount sections can thus be pushed into one another. The roll holder in accordance with the invention can thus also be used with label rolls having particularly small widths.

It is furthermore preferred if the first roll mount is formed as an assembly that can be handled in common and/or if the second roll mount is configured as an assembly that can be handled in common. The handling effort for an operator is thus particularly small. Furthermore, further separate parts that can be laid or can be lost can be avoided.

In accordance with a further embodiment of the invention, the first roll mount is axially fixedly arranged, in particular preinstalled, with respect to the holding mandrel in the roll holder. On insertion of a label roll, it is pushed onto the holding mandrel up to the first roll mount and is then pushed with its first end to the front onto the first roll mount. Subsequently, the second roll mount is pushed onto the holding mandrel until it engages into the label roll at its second end. The axially fixed arrangement can in particular be achieved by a brake mechanism such as will be explained in more detail below. It is, however, generally also possible that the second roll mount can be pushed onto the holding mandrel from the unsupported end of the holding mandrel or that the two roll mounts can be pushed together with a label roll arranged therebetween onto the holding mandrel from the unsupported end of the holding mandrel The first roll mount or—for the case of a multipart roll mount, e.g. having a roller element bearing—at least a part thereof is in particular rotatably supported with respect to the holding mandrel.

A fixed position support element, in particular a bearing plate, in particular pushed onto the holding mandrel and/or fastened to the carrier, is preferably provided for a sliding support of the first roll mount and/or as an axial end abutment for the first roll mount. Separate devices can generally also be provided for the sliding support of the first roll mount, on the one hand, and for providing an axial end abutment for the first roll mount, on the other hand. The provision of an outer element and of an inner element as with the second roll mount is not necessary here.

In accordance with a further embodiment of the invention, the roll holder comprises a brake mechanism for the label roll. The brake mechanism preferably has a tensioning roll fixedly connected to the first roll mount and a belt wrapping around the tensioning roll, with the one end of the belt being fixed at a fixed-position fastening and the other end of the belt being coupled to a deflection roller for a label band of the label roll that is movable between a release position in which the belt is loosened at the tensioning roll and a braked position in which the belt is tensioned at the tensioning roll. This can in particular be achieved in a simple manner in that the coupling between the other end of the belt and the deflection roller takes place via a lever mechanism and/or that the deflection roller is preloaded in the direction of the braked position by means of a tension spring. For example, when the label band of the label roll is pre-stressed in tension such as is typically the case when a label is processed for printing and for applying to a product, the deflection roller is adjusted into the release position, whereby the label roll is freely rotatable. Otherwise, the deflection roller returns to the braked position, whereby the free rotation of the label roll is counteracted. The aforesaid brake mechanism works particularly simply and easily in the roll holder in accordance with the invention.

The present invention furthermore relates to a label printer, in particular for a packaging machine for wrapping products with a packaging film, having a roll holder such as has been described above. In addition to the roll holder in accordance with the invention, the label printer in accordance with the invention in particular furthermore has a printing unit, in particular with a printhead, as well as a winding mandrel and a motor rotationally driving the winding mandrel.

The present invention further relates to a packaging machine, in particular for wrapping products with a packaging film, having at least one label printer such as has been described above.

Advantageous embodiments of the invention are also specified in the dependent claims, in the further description and in the drawing.

Figure 2:
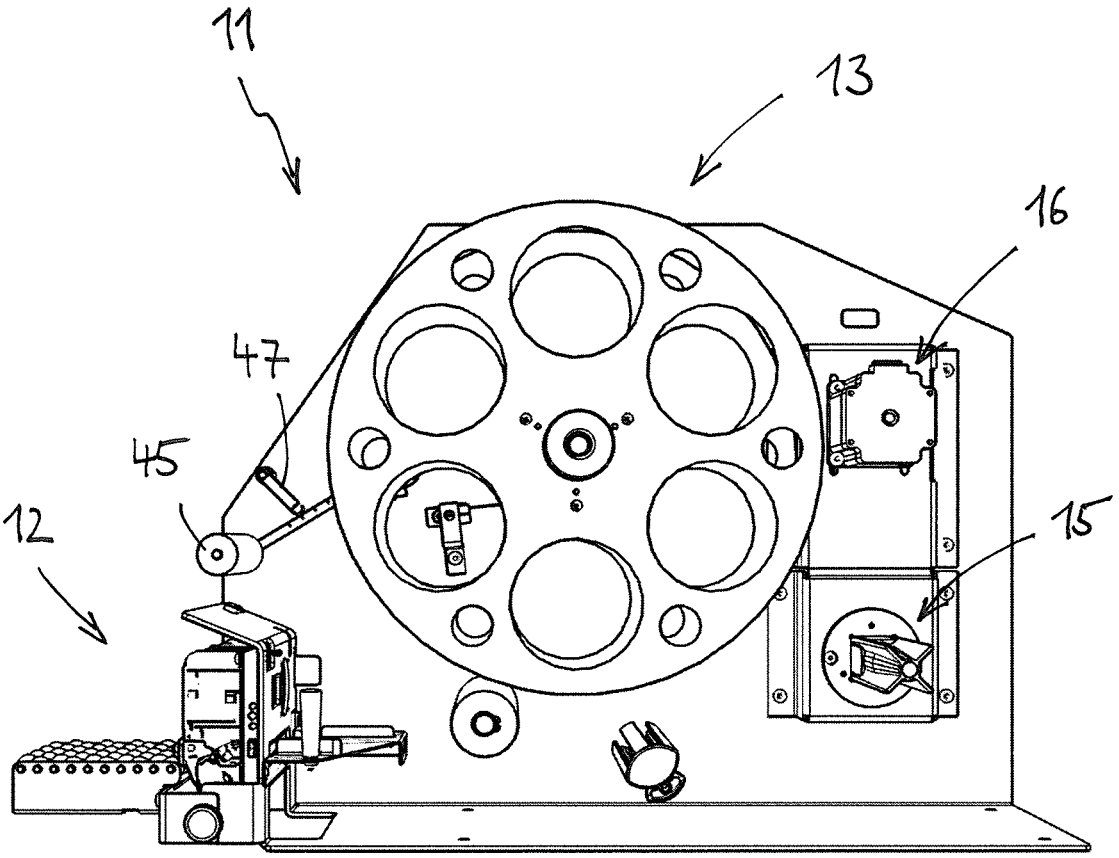
Figure 3:
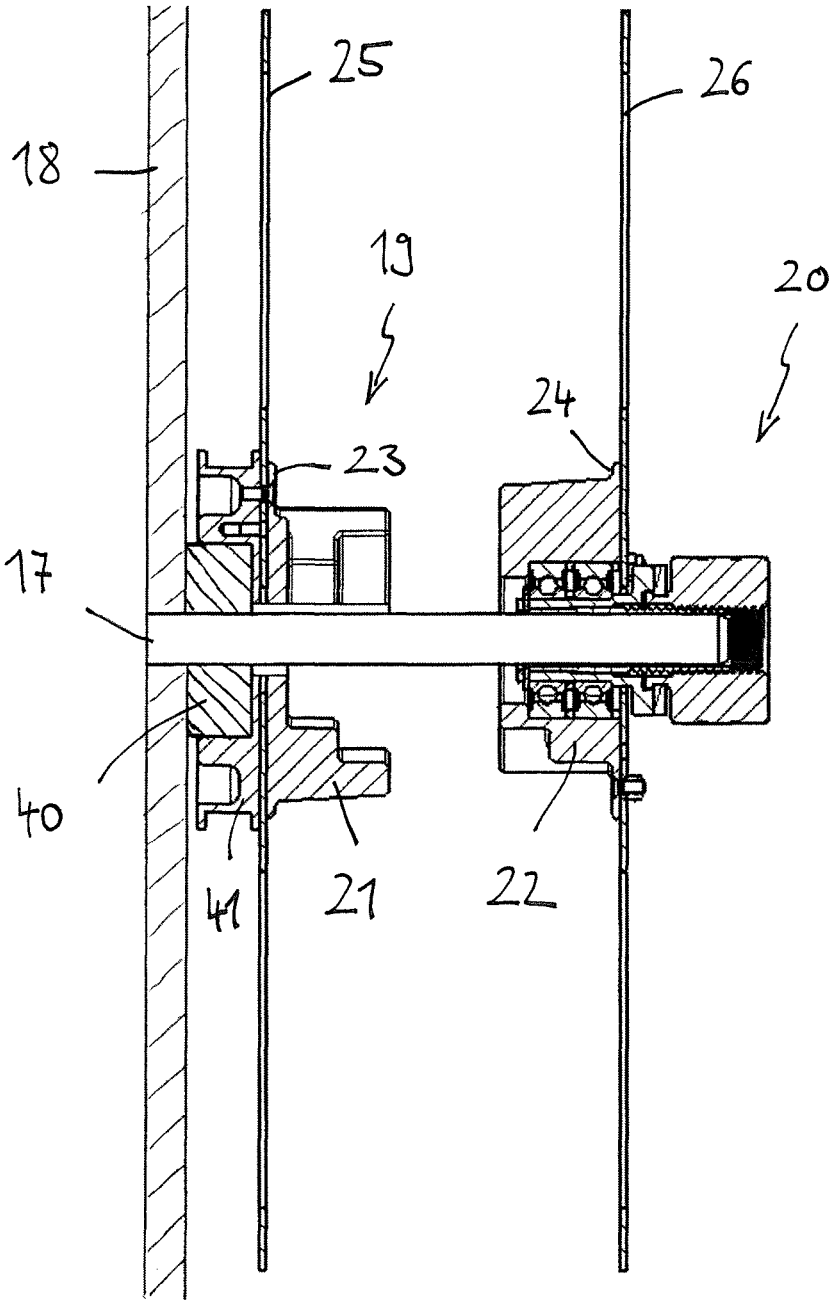
Figure 4:
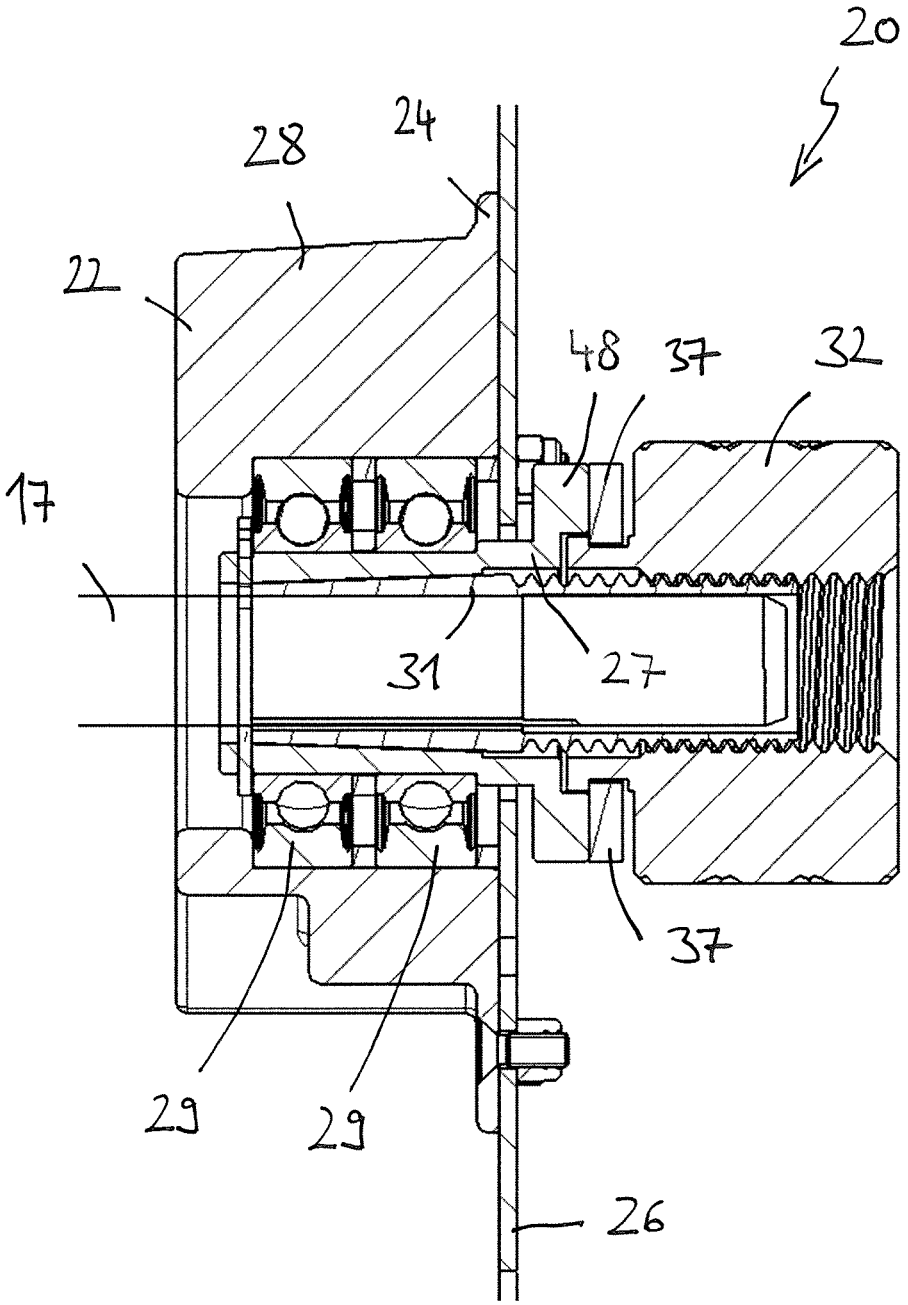
Figure 5A:
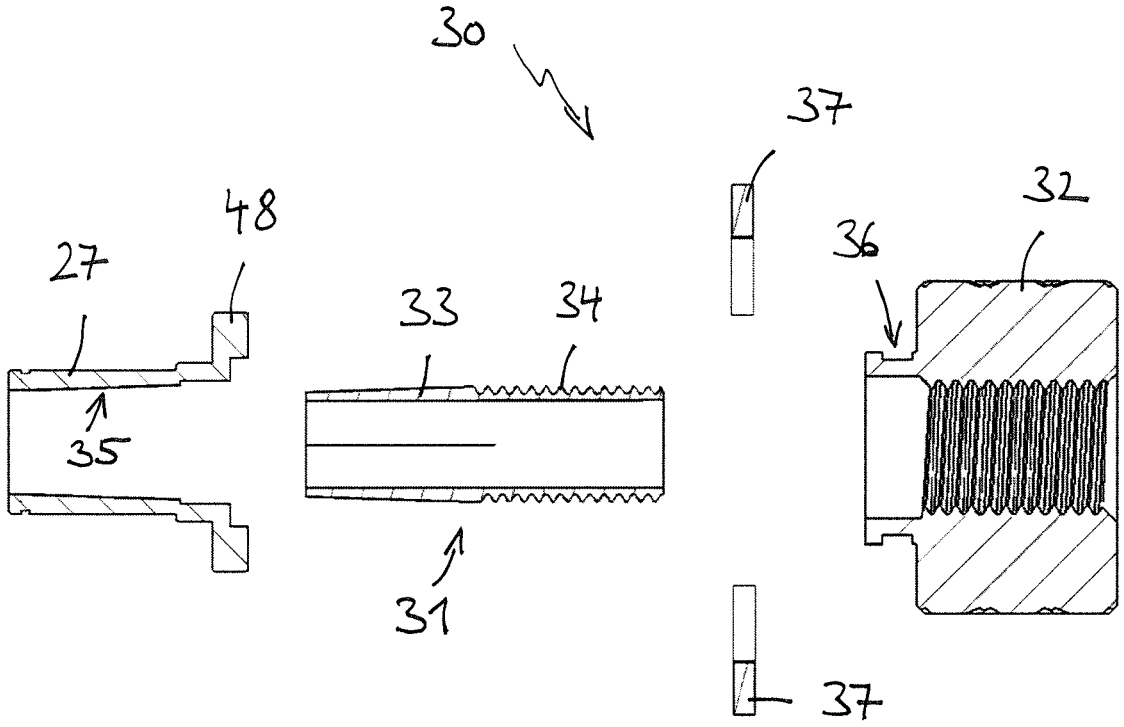
Figure 5B:
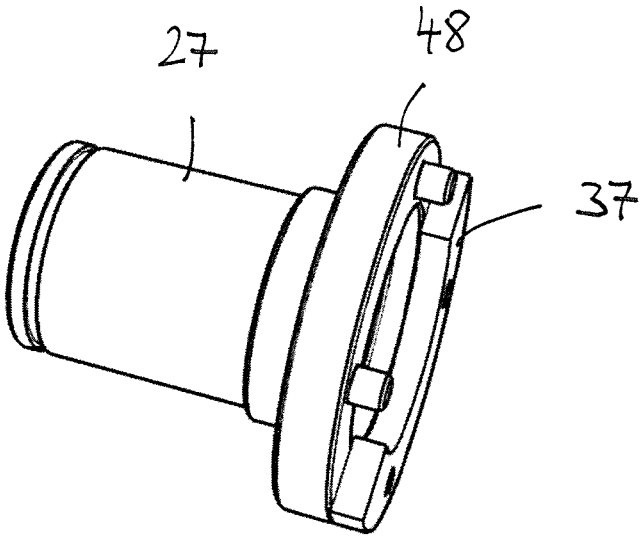
Figure 6A:
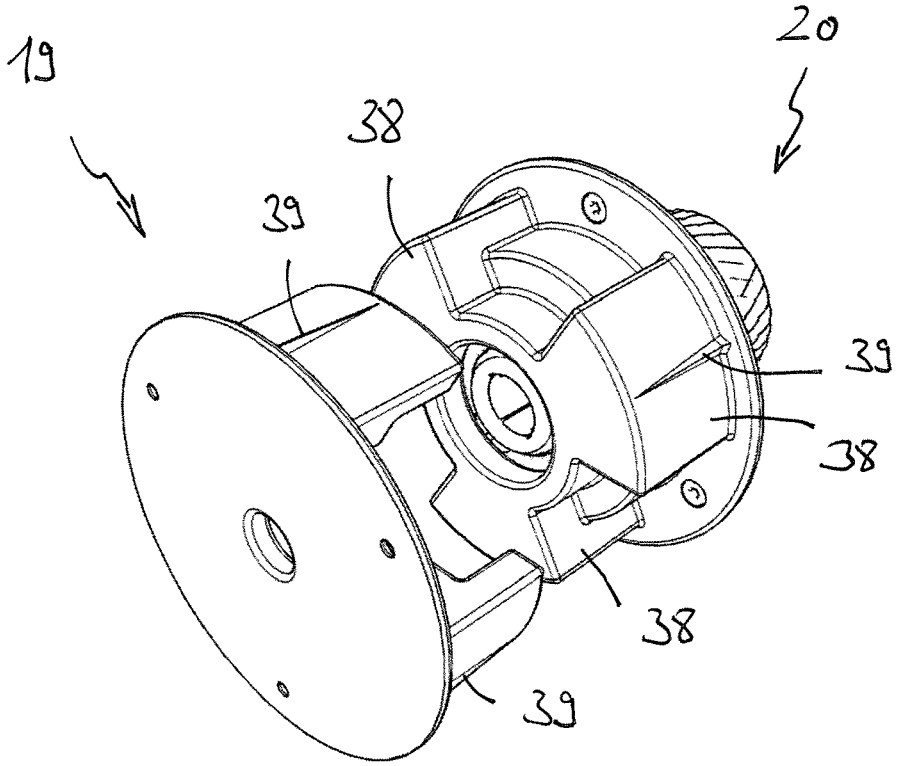
Figure 6B:
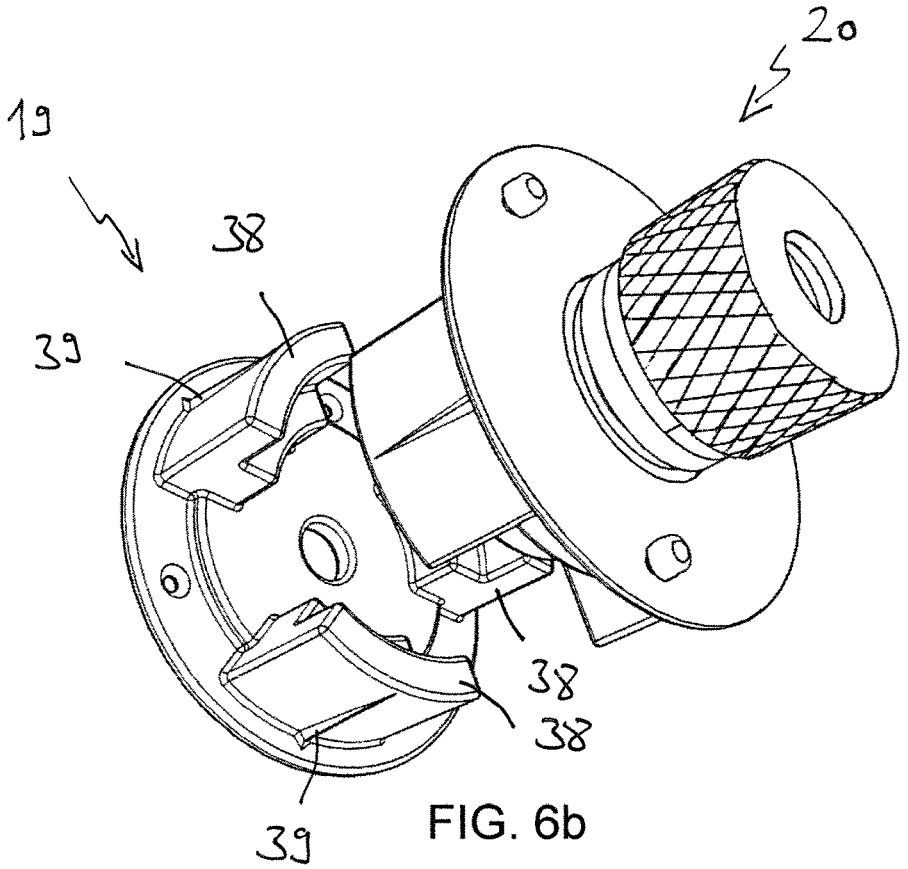
Figure 7:
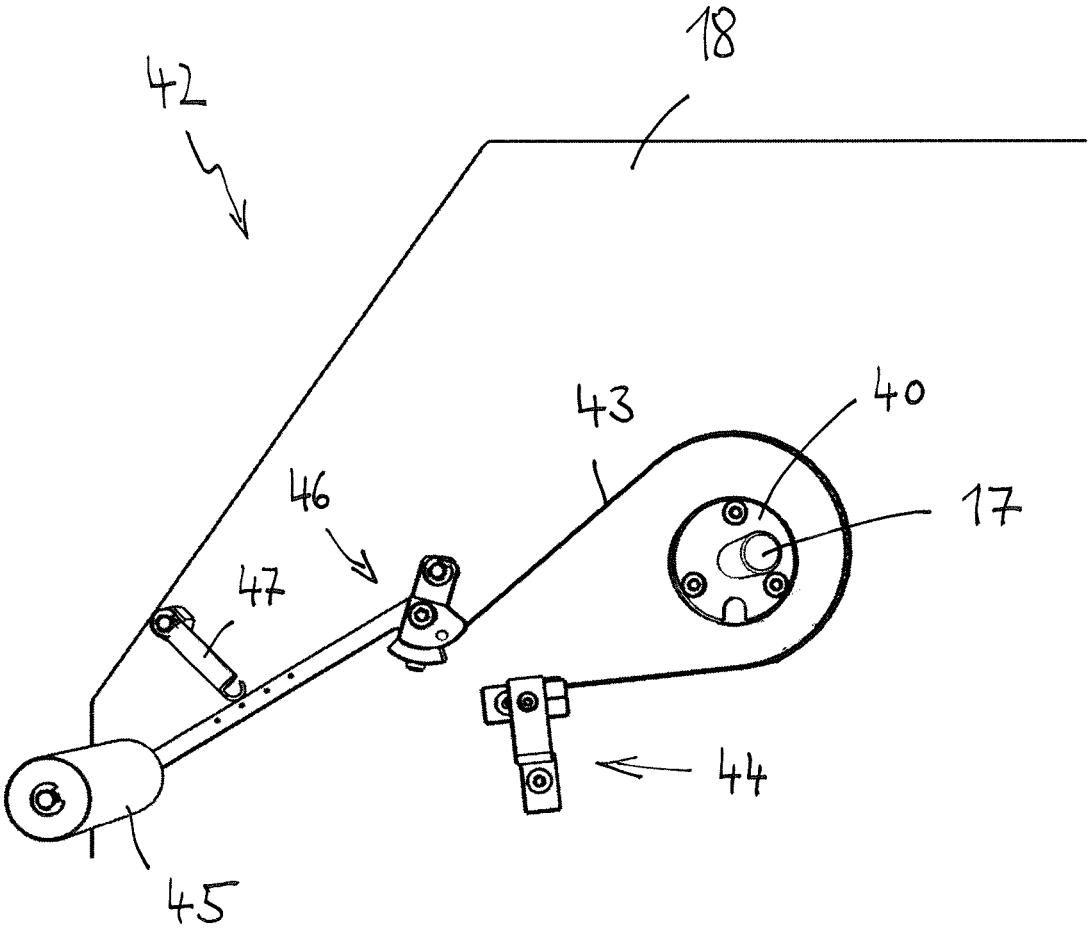

A non-restrictive embodiment of the invention is illustrated in the drawing and will be described in the following. There are shown FIG. 1 a schematic representation of a film packaging machine;

FIG. 2 a label printer for the film packaging machine of FIG. 1 with a roll holder for a label roll;

FIG. 3 a section through the roll holder of FIG. 2 with a first and a second roll holder;

FIG. 4 an enlarged representation of the second roll holder in accordance with FIG. 3;

FIG. 5*a* an exploded representation of the second roll holder in accordance with FIG. 4;

FIG. 5*b* a perspective view of a part of the second roll holder in accordance with FIG. 4;

FIG. 6*a* a perspective view of the first and second roll holders of FIG. 3;

FIG. 6*b* a further perspective view of the first and second roll holders of FIG. 3; and FIG. 7 a brake mechanism for the label roll in accordance with FIG. 2.

In FIG. 1, a schematic plan view is shown in the upper part of the Figure and a side view of a packaging machine 100 is shown in the lower part of the Figure.

The packaging machine 100 comprises a film dispensing device 217, a film supply device 216, a film transport device 214, and a film cutting device 215 arranged between the film supply device 216 and the film transport device 214. A roll of a packaging film K, in particular of a plastic film, can be placed into the film dispensing device 217 and can be held there by a film holder or roll holder. An unwound end of the film K can then be transferred to the film transport device 214 by means of the film supply device 216.

The film transport device 214 has two belt conveying devices 201 and 22 that are arranged spaced apart in parallel with one another to convey the supplied film K to two mutually oppositely disposed sides in a direction of transport X until the front edge of the film K has arrived at the end of the film transport device 214 at the front viewed in the direction of transport X, whereupon the film transport is stopped and the film K is cut off from the remaining film roll via the film cutting device 215. The belt conveying devices 201 and 202 are furthermore configured to hold the film K, in particular the cut-off film K, clampingly at two mutually opposite sides. For this purpose, for example, lifting actuators, not shown, can be provided such as are generally known from the prior art.

The packaging machine 100 furthermore has a supply belt 102 via which packaging trays P wrapped with the film K and having food products located therein can be supplied to a lifting table 105 of the packaging machine 100. The lifting table 105 is configured to transport a respective tray P upwardly to the film K held in the film transport device 214 such that the tray P is pressed toward the tray K from below such that the film K is automatically placed around the tray P during the lifting procedure.

For the further wrapping of the packing trays P, the film K is led downwardly at the sides and at the rear by means of lateral folding tongs 108*a* and 108*b* as well as by rear folding tongs 110 about the tray P after the lifting of the packaging tray P and is folded beneath the tray P or beneath the base of the tray P. The tray P is subsequently pushed out of the film packaging zone by means of a pusher 109 onto a sealing plate 107, whereby the front end of the film K is also folded beneath the tray P. The sealing plate 107 is heated to a temperature at which the ends of the film K folded beneath the tray P are welded to one another and sealed.

The packed tray P can subsequently be provided with a label by a labeling apparatus not shown in FIG. 1. A scale 101 is arranged beneath the supply belt 102 for this purpose and the weight of the supplied packaging trays P having the food products can be determined by it. A respective label printer, not shown in FIG. 1, that is respectively connected to the scale 101 is provided approximately in front of the lateral folding tongs 108*a* in the direction of transport X and behind the lateral folding tongs 108*b*—or to the left and right of the lifting table 105 in a front view of the packaging machine 100. The two printers can alternatingly print a label on which the weight of a respective filled tray P is specified. The labeling apparatus takes over the label from the printer and applies it to the packed tray P. The packed and labeled tray P can finally be transported off via a transverse conveyor belt 106.

An embodiment in accordance with the invention of the label printer to the right of the lifting table 105 is shown in FIG. 2. The label printer 11 comprises a printing unit 12 having a printhead, as well as a roll holder 13 in accordance with the invention that is equipped with a label roll, not shown, having a roll core and a label band wound thereon and that will be explained in more detail in connection with the further FIGS. 3 to 7, a winding mandrel 15 for the aforesaid label band once the label band has passed the printer 11, and an electric motor rotationally driving the winding mandrel 15.

The roll holder 13 in accordance with FIG. 3 first comprises a fixed-position holding mandrel 17 whose one end is fastened to a carrier in the form of a housing wall 18 and that horizontally projects from it. The roll holder 13 furthermore comprises a first roll mount 19 and a second roll mount 20 that is separate from the first roll mount 19. The two roll mounts 19, 20 are configured such that the aforesaid label roll is arranged between the two roll mounts 19, 20 in the received state. For this purpose, first and second mounting sections, 21, 22 respectively of the two roll mounts 19, 20 that each taper conically engage into the first and second ends respectively of the hollow cylindrical roll core of the label roll so that the label roll is held between the two roll mounts 19, 20. The first roll mount 19 is axially fixedly preinstalled in the roll holder 13 via a brake mechanism explained in more detail below. The label roll and subsequently the second roll mount 20 can then be pushed onto the holding mandrel 17 to load the holding mandrel 17. Label rolls having different widths and having mutually different inner diameters of the hollow cylindrical roll cores of the label rolls can be used by a roll holder 13 setup in this manner.

The two roll mounts 19, 20 further comprise a respective peripheral first and second flange 23, 24, to which a respective first and second boundary disk 25, 26 for the label roll received between the two roll mounts 19, 20 is fastened via screw connections. Furthermore, the two roll mounts 19, 20 are each formed as assemblies so that the roll holder 13 only comprises exactly two loose parts, namely the first roll mount 19 and the second roll mount 20, whereby high operating comfort of the roll holder 13 is ensured.

As can be recognized in detail from FIGS. 4 and 5, the second roll mount 20 is assembled from a plurality of elements. The second roll mount 20 in particular comprises a sleeve-like inner element 27 and an outer element 28. The second roll mount 20 can be pushed onto the holding mandrel 17 via the inner element 27. The outer element 28 comprises the second mount section 22 and the second flange 24 and is rotatably supported on the inner element 27 via two ball bearings 29 arranged directly next to one another.

A clamping mechanism 30 is furthermore provided by which the inner element 27 can be rotationally fixedly and axially fixedly fixed to the holding mandrel 17. The clamping mechanism 30 for this purpose comprises a clamping sleeve 31 that is coaxial to the inner element 27 in the placed on state, that is arranged between the holding mandrel 17 and the inner element 27, and that has a clamping section 33, a coupling section 34, and a ring nut 32. The clamping section 33 of the clamping sleeve 31 has a conical outer diameter. Corresponding to this, the inner element 27 has a contact section 35 that is likewise conical, but is formed in a counter-shape, so that by displacing the clamping sleeve 31 in the axial direction into a blocked position, a clamping connection can resulting from the two cones can be established between the clamping sleeve 31 and the inner element 27 to fix the inner element 27 in a rotationally fixed and axially fixed manner to the holding mandrel 17. The label roll can thus be fixed rotatably, on the one hand, and axially fixedly, on the other hand, on the fixed-position holding mandrel 17. To release the second roll mount 20 from the holding mandrel 17, the two cones are released from one another again, i.e. the clamping sleeve 31 is displaced into a corresponding release position.

To displace the clamping sleeve 31, the coupling section 34 of the clamping sleeve 31 is provided with an external thread onto which the ring nut 32 provided with a matching internal thread is screwed, with the ring nut 32 simultaneously being axially fixedly coupled to the inner element 27. The axially fixed coupling of the ring nut 32 to the inner element 27 is achieved in that the ring nut 32 has an undercut 36 at its end section facing the inner element 27, with two securing elements in the form of two semicircular ring washers 37 being plugged into said undercut 36 and subsequently being screwed to a flange 48 of the inner element 27 facing the ring nut 32 such as is shown in FIG. 5*b*, with only one of the two semicircular ring washers 37 being shown in FIG. 5*b*.

It can additionally be seen from FIGS. 6*a* and 6*b* that the two mount sections 21, 22 each have a plurality of prolongations 38 that are arranged distributed in the peripheral direction. The prolongations 38 of the two mount sections 21, 22 are configured here such that they can engage into one another in a finger-like manner on at least a discrete rotational position of the two mount sections 21, 22 toward one another so that the two mount sections 21, 22 can be pushed into one another. The roll holder 13 in accordance with the invention can hereby also be used with particularly narrow label rolls.

It can furthermore be seen from FIGS. 6*a* and 6*b* that the prolongations 38 of the two mount sections 21, 22 are each provided with a sharp-edged rib 39, said ribs 39 tapering to a point in the axial direction, in each case toward the label roll. The ribs 39 press into the respective end of the roll core of the label roll on engagement so that the label roll is securely held on the two mount sections 21, 22, in particular on the prolongations 38.

A fixed-position bearing plate 40 is furthermore provided that is pushed onto the holding mandrel 17 up to the housing wall 18 (cf. FIG. 3) and is fastened to the housing wall 18. The bearing plate 40, on the one hand, serves as an axial abutment and, on the other hand, as part of a plain bearing for the first roll mount 19. To form the plain bearing, a roll 41 is provided at the rear side of the first boundary disk 25 and is fixedly connected to the first boundary disk 25 or is fixedly connected to the first roll mount 19 and is slidingly supported on the bearing plate 40.

The roll 41 is simultaneously part of a brake mechanism 42 for the label roll and acts as a tensioning roll 41 in so doing. The brake mechanism 42 further comprises a belt 43, such as is shown in FIG. 7, that wraps around the tensioning roll 41, with the tensioning roll 41 being omitted there. The one end of the belt 43 is here attached to a fixed-position fastening 44 and the other end of the belt 43 is coupled to a deflection roll 45 for the aforesaid label band of the label roll not shown in FIG. 7. The coupling between the belt 43 and the deflection roll 45 takes place via a lever mechanism 46, with the deflection roll 45 being downwardly pivoted into a release position with a label band under tensile loading, whereby the belt 43 is loosened at the tensioning roll 41. If the tensile loading on the label band is removed, the deflection roll 45 is pivoted back into a braked position by means of a tension spring 47, whereby the belt 43 is tensioned at the tensioning roll 41 and a braking effect is thus initiated on the label roll. The first roll mount 19 is in another respect also axially fixedly held in the roll holder 13 by the brake mechanism 42, in particular by the belt 43 and by the tensioning roll 41.

REFERENCE NUMERAL LIST

11 label printer
12 print unit
13 roll holder
15 winding mandrel
16 electric motor
17 holding mandrel
18 housing wall
19 first roll mount
20 second roll mount
21 first mount section
22 second mount section
23 first flange
24 second flange
25 first boundary disk
26 second boundary disk
27 inner element
28 outer element
29 ball bearing
30 clamping mechanism
31 clamping sleeve
32 ring nut
33 clamping section
34 coupling section
35 contact section
36 undercut
37 semicircular ring nut
38 prolongation
39 rib
40 bearing plate
41 tensioning roll
42 brake mechanism
43 belt
44 fastening
45 deflection roller
46 lever mechanism
47 tension spring
48 flange
100 packaging machine
101 scale
102 supply belt
104 light barrier
105 lifting table
106 transverse conveyor belt
107 sealing plate
108*a* lateral folding tongs
108*b* lateral folding tongs
109 pusher
110 rear folding tongs
201 belt conveying device
202 belt conveying device
214 film transport device
215 film cutting device
216 film supply device
217 film dispensing device
K packaging film
P packaging tray (having the food product)
X direction of transport

The invention claimed is:

1. A roll holder for a label roll, comprising:

a horizontally arranged, fixed-position holding mandrel whose one end is fastened to a carrier and whose other end projects in an unsupported manner from the carrier; and a first roll mount and a second roll mount, separate from the first roll mount, with the first roll mount being configured to engage into a first end of the label roll, and with the second roll mount being configured to engage into a second end of the label roll such that the label roll is receivable between the first roll mount and the second roll mount, wherein the second roll mount is configured to be pushed onto the holding mandrel from the unsupported end of the holding mandrel, and wherein the second roll mount comprises an inner element axially spaced from the first roll mount and configured to be pushed onto the holding mandrel, an outer element that engages into the second end of the label roll and that is axially fixedly and rotatably supported on the inner element, and a clamping mechanism configured to fix the inner element rotationally fixedly and axially fixedly on the holding mandrel.

2. The roll holder in accordance with claim 1, wherein:

the clamping mechanism comprises a clamping insert that is coaxial to the inner element and is arranged between the holding mandrel and the inner element, and that is adjustable by an axial adjustment between a release position in which the inner element is displaceable on the holding mandrel and a blocked position in which the inner element is rotationally fixedly and axially fixedly fixed on the holding mandrel.

3. The roll holder in accordance with claim 2, wherein:

the clamping insert has a clamping section having a conical outer diameter and the inner element has a contact section having a counter-shaped conical inner diameter to form a conical clamping connection in the blocked position of the clamping insert.

4. The roll holder in accordance with claim 2, wherein:

the clamping mechanism comprises an actuation element coupled to the clamping insert to adjust the clamping insert between the release position and the blocked position.

5. The roll holder in accordance with claim 4, wherein:

the actuation element is axially fixedly coupled to the inner element and is configured as a ring nut having an internal thread that is screwed onto an external thread of a coupling section of the clamping insert for coupling to the clamping insert.

6. The roll holder in accordance with claim 5, wherein:

the actuation element has an undercut at its end section facing the inner element and at least one securing element that is screwed to the inner element is inserted into said undercut.

7. The roll holder in accordance with claim 1, wherein:

the outer element is rotatably supported on the inner element by at least one roller element bearing provided between the outer element and the inner element.

8. The roll holder in accordance with claim 1, wherein:

the first roll mount and the second roll mount each comprise a flange to each of which a respective boundary disk for the label roll is fastened.

9. The roll holder in accordance with-claim 1, wherein:

the first roll mount comprises a first mount section to engage into the first end of the label roll and the second roll mount comprises a second mount section to engage into the second end of the label roll.

10. The roll holder in accordance with claim 9, wherein the two mount sections each taper conically.

11. The roll holder in accordance with claim 9, wherein:

the two mount sections each have at least one sharp-edged rib, said ribs pressing into the respective end of the label roll on engagement.

12. The roll holder in accordance with claim 1, wherein:

the first roll mount is formed as an assembly that can be handled in common;

and/or in that the second roll mount is formed as an assembly that can be handled in common.

13. The roll holder in accordance with claim 1, wherein:

the first roll mount is arranged axially fixedly with respect to the holding mandrel in the roll holder; and/or in that the first roll mount or at least a part thereof is rotatably supported with respect to the holding mandrel.

14. The roll holder in accordance with claim 1, wherein:

a fixed position support element, is provided for a sliding support of the first roll mount and/or as an axial end abutment for the first roll mount.

15. The roll holder in accordance with claim 1, wherein the roll holder comprises a brake mechanism for the label roll.

16. The roll holder in accordance with claim 15, wherein:

the brake mechanism comprises a tensioning roll fixedly connected to the first roll mount and a belt wrapping around the tensioning roll, with the one end of the belt being fixed to a fixed-position fastening and the other end of the belt being coupled to a deflection roller for a label band of the label roll that is movable between a release position in which the belt is loosened at the tensioning roll and a braked position in which the belt is tensioned at the tensioning roll.

17. The roll holder in accordance with claim 16, wherein:

the other end of the belt is coupled to the deflection roller via a lever mechanism; and/or in that the deflection roller is preloaded in the direction of the braked position by means of a tension spring.

18. A label printer for a packaging machine for wrapping products with a packaging film, comprising a roll holder in accordance with claim 1.

19. A packaging machine for wrapping products with a packaging film, comprising at least one label printer in accordance with claim 18.

* * * * *